US005445212A

United States Patent [19]

Frauenkron et al.

[11] Patent Number: 5,445,212

[45] Date of Patent: Aug. 29, 1995

[54] CASTING WHEEL FOR A STRIP CASTING MACHINE

[75] Inventors: Armin Frauenkron, Iserlohn; Volker Ilchmann, Menden; Erhard Vogt, Düsseldorf; Herbert Gellenbeck, Hemer-Sundwig, all of Germany

[73] Assignee: Sundwiger Eisenhutte Maschinenfabrik GmbH & Co., Hemer-Sundwig, Germany

[21] Appl. No.: 57,710

[22] Filed: May 4, 1993

[30] Foreign Application Priority Data

May 8, 1992 [DE] Germany ..... 42 14 729.8

[51] Int. Cl.[6] ..... B22D 11/06

[52] U.S. Cl. ..... 164/429; 164/435

[58] Field of Search ..... 164/463, 479, 480, 482, 164/484, 435, 427, 428, 429, 432, 433, 442, 448

[56] References Cited

U.S. PATENT DOCUMENTS

| | | | |
|---|---|---|---|
| 2,383,310 | 8/1945 | Hazelett | 164/429 |
| 2,950,507 | 8/1960 | Keyser . | |
| 3,712,366 | 1/1973 | Gerding | 164/479 |
| 3,756,304 | 9/1973 | Gerding | 164/479 |

FOREIGN PATENT DOCUMENTS

| | | | |
|---|---|---|---|
| 2149941 | 4/1973 | Germany . | |
| 3801085 | 7/1989 | Germany . | |
| 0180648 | 9/1985 | Japan | 164/463 |
| 3215347 | 9/1988 | Japan | 164/480 |
| 4322846 | 11/1992 | Japan | 164/428 |
| 9110520 | 7/1991 | WIPO | 164/428 |
| WOA9110520 | 7/1991 | WIPO . | |

*Primary Examiner*—P. Austin Bradley
*Assistant Examiner*—Erik R. Puknys
*Attorney, Agent, or Firm*—Meltzer, Lippe, Goldstein et al.

[57] ABSTRACT

The invention relates to a casting wheel of a strip casting machine. The casting wheel comprises a casting ring (30) mounted and borne internally on freely rotatable rollers (31*a, b*, 33*a, b*). In the zone of the position at the start of casting, the rollers (31*a, b*) are rigidly mounted via a supporting element (32), while on the opposite side they are radially adjustable via a-supporting element (34*a, b*). In this way deformations of the casting ring (30) due to heating during casting can be absorbed without a change in the position of the casting ring (30) as at the start of casting. The casting ring (30) is driven from outside via at least one driving element (30*b*) which is connected via a transmission member (30*a*) to the casting ring (30).

25 Claims, 3 Drawing Sheets

CASTING WHEEL FOR A STRIP CASTING MACHINE

Figure 1:
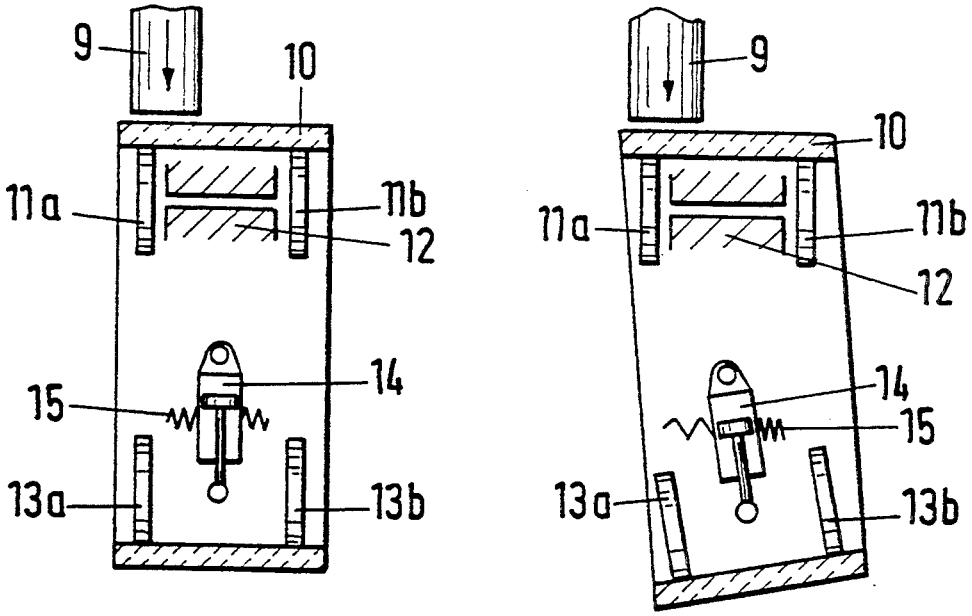
Figure 2:
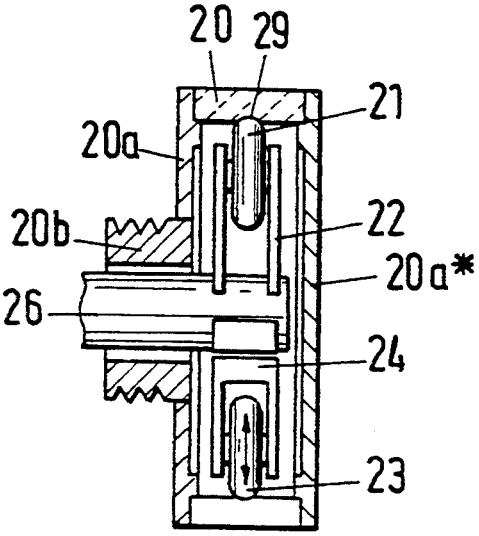

The invention relates to a casting wheel for a strip casting machine, having a casting ring rotatably mounted internally on rollers.

In a known strip casting machine (DE 40 01 047 C2) two casting wheels of the aforementioned kind form an exit gap for the molten metal. The internally disposed rollers are mounted rigidly in a fixed roller core. One difficulty of strip casting using one or two casting wheels of that kind is to keep the exit gap for the molten metal, formed between the single casting wheel or the two casting wheels with a tundish, constant in spite of the thermal deformation of the or each casting wheel.

It is an object of the invention to provide a casting wheel of the kind specified wherein the position of the casting ring in the position at the start of casting remains unchanged even during casting operation.

This problem is solved according to the invention by the features that the or each roller is mounted radially rigid in the zone of the position at the start of casting on one or more supporting elements, while the opposite rollers are borne radially adjustably on one or more further supporting elements.

With the casting wheel according to the invention, deformations of the casting ring occurring due to heating during casting operation are absorbed by the or each roller disposed opposite the position at the start of casting, the casting ring being so displaced away from the position at the start of casting that the portion of the casting ring situated in the zone of the position at the start of casting remains unchanged in its position on the radially rigid supporting element. The passage gap between the casting ring and a casting nozzle or tundish or a further casting wheel is in this way maintained substantially constant even during casting. Any changes in the casting gap still occurring due to the thermal expansion of the wall thickness of the casting ring are either negligible or can be detected and corrected by a known roller gap control system.

According to one possible feature of the invention for the radial adjustability of the rollers, the or each roller and/or the particular associated supporting element is mounted resiliently. The supporting element can also be acted upon hydraulically, while the rollers are mounted resiliently.

To enable even a conical deformation of the ring to be absorbed, each roller form radially adjustably on the or each further supporting element can be pivoted in relation to the axis of the casting ring.

Preferably the supporting elements are disposed on a common rigid carrying shaft.

The carrying shaft should be rotatable, to move the rollers with their supporting elements into the position at the start of casting.

One roller is enough to support the casting ring in the zone of the position at the start of casting. Preferably, to improve support, at least two rollers offset in relation to one another in the peripheral direction of the casting ring are provided in the zone of the position at the start of casting. The rollers do not have to have a generated surface extending over the entire width of the ring, but they can be made up of a number of wheels disposed spaced-out from one another. To enable the wheels to be equipped with casting rings of different widths, according to another feature of the invention the spacing between the wheels of each roller is adjustable.

If each of the radially adjustable rollers consists of a number of wheels, advantageously the wheels are adjustable independently of one another, so that they can be adapted even to a conical deformation of the ring. This can be effected in various ways, for example, by each wheel having its own associated supporting element, or by the wheels of each roller being mounted on a common pivotable shaft.

The rollers or wheels can have the same diameter, but for certain cases it may be convenient for the wheels to have a different diameter.

To fix the casting ring axially on the rollers, according to a possible feature of the invention the casting ring has internally at least one guide track for the roller provided in the zone of the position at the start of casting. Instead of this internal axial guide, a guide engaging externally with the casting ring can be provided.

Preferably the rollers are mounted freely rotatable and the casting ring is externally driven. Constructionally this can be achieved by a transmission member disposed at the end face and a driving wheel borne by said member. This kind of drive is much simpler than driven rollers and reduces the risk of the ring overrunning in relation to the drive.

As a protection against accident and/or for the cooling of the casting wheel, the casting ring can be closed at both end faces by a plate, the carrying shaft being sealed at its lead-in through the plate. Coolants can be supplied to and removed from the resulting inner space in a controlled manner to cool the parts of the casting wheel. For example, the coolant can be sprayed via spraying nozzles distributed in the upper zone of the casting wheel on to the inside thereof, the coolant being collected in the bottom zone of the inner cavity and thence removed via a pipe, so that the coolant remains inside the casting wheels.

The special advantages of the invention are as follows: as already mentioned, constant and reliable maintenance of the passage gap formed between the casting ring and a casting nozzle or a tundish or a second casting wheel; the improved driving of the casting ring; the ready interchangeability of the casting ring; and the possibility of machining the surface of the casting ring in the strip casting machine by means of a turning device which is moved into the position at the start of casting, or into whose position the casting ring is moved by the rotation of the rigid support.

Figure 3:
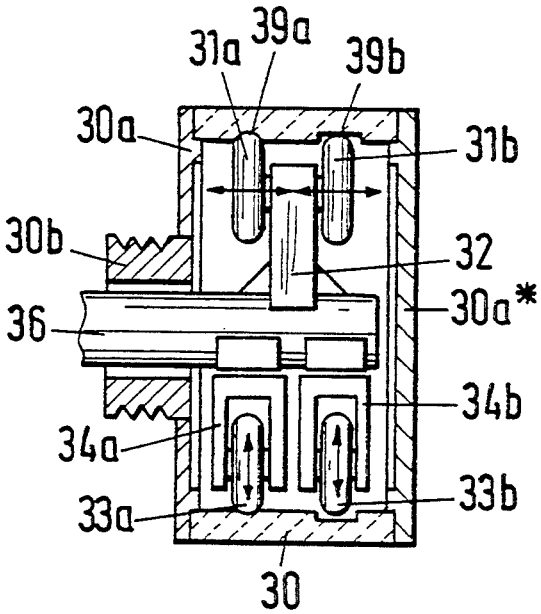
Figure 4:
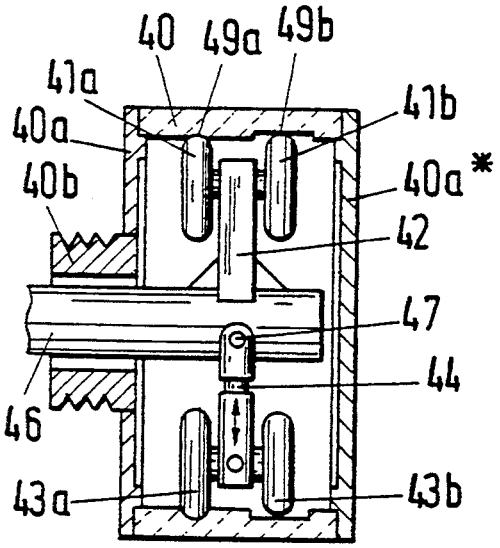
Figure 5:
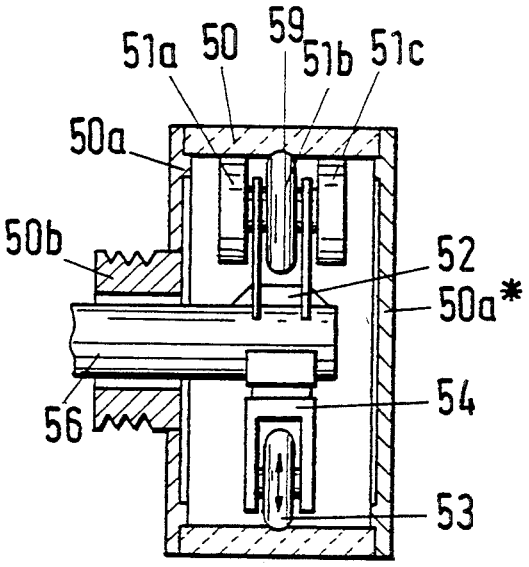
Figure 6:
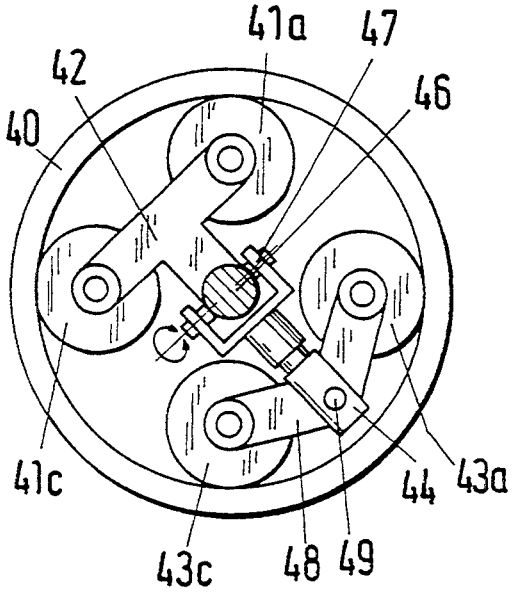
Figure 7:
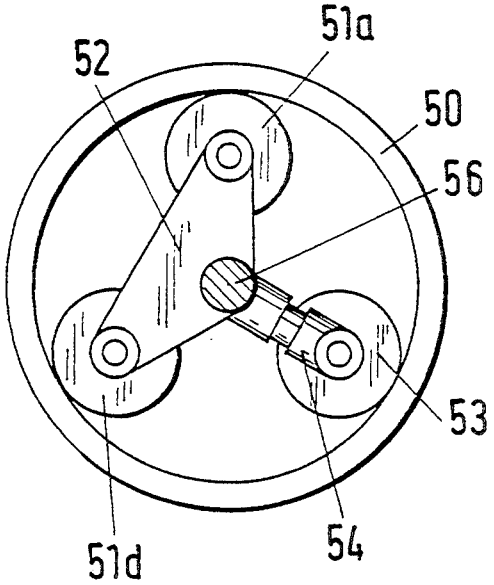
Figure 8:
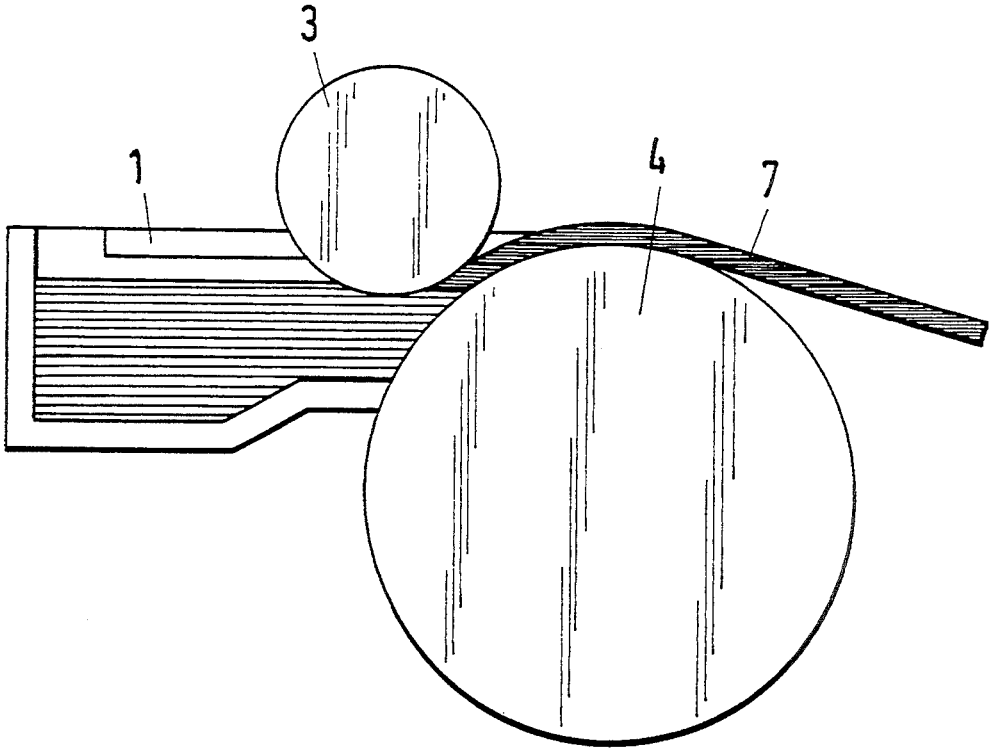
Figure 9:
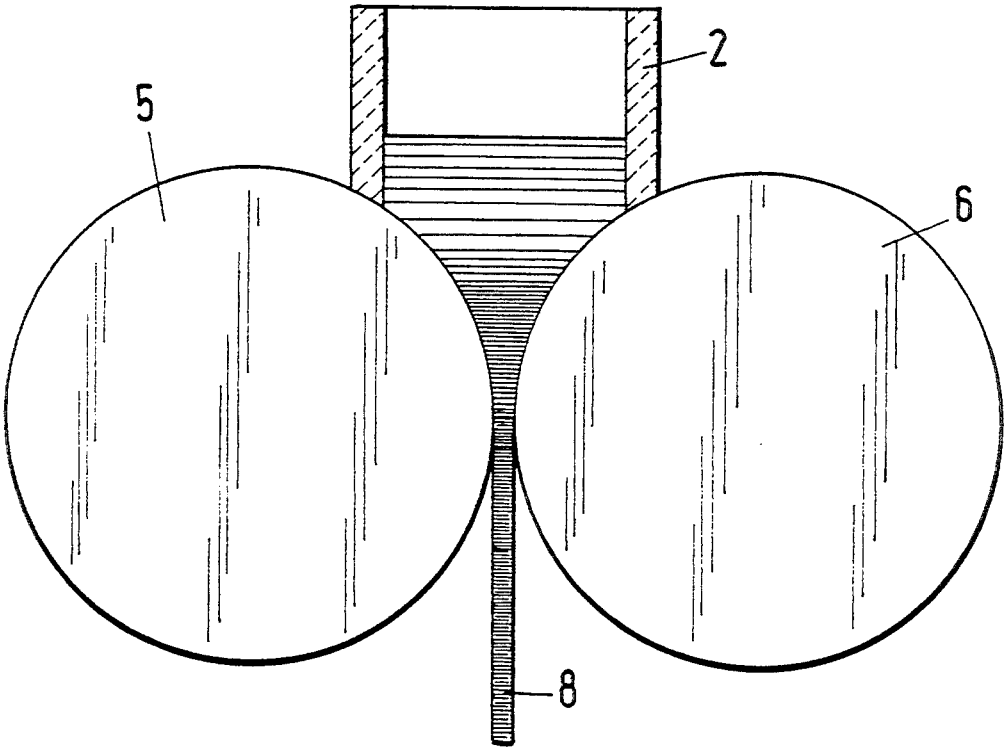

Embodiments of the invention will now be explained in greater detail with reference to the drawings, wherein:

FIG. 1 is an axial section illustrating the basic construction of a casting wheel, shown on the left before and on the right after the start of casting, FIGS. 2 to 5 are axial sections through different embodiments of a casting wheel, FIG. 6 is an end elevation of the casting wheel as shown in FIG. 4, FIG. 7 is an end elevation of the casting wheel as shown in FIG. 5, and FIGS. 8 and 9 are side elevations of different embodiments of two strip casting machines each having two casting wheels.

Referring to FIGS. 8 and 9, a strip casting machine comprises a casting vessel 1, 2 containing molten metal, and two casting wheels 3–6 which can have different or identical diameters. In the embodiment shown in FIG. 8 the casting wheel 3 of smaller diameter can be a solid roller. In contrast, the casting means 4–6 have the construction according to the invention, which will be described in detail hereinafter. The two casting wheels 3–6 close the exit from the casting vessel except for a passage gap through which molten metal can emerge to form a strip 7, 8. The casting wheels 3–6 are preferably cooled, so that the strip 7, 8 leaving the casting wheels 3–6 is solidified. However, instead of the casting wheel 3, a tundish or a casting nozzle can be associated with the casting wheel 4 and cooperate therewith to form the exit gap for the molten metal.

FIG. 1 shows the basic construction of a casting wheel according to the invention. Together with a tundish or casting nozzle 9 a casting ring 10 forms a passage gap for molten metal, which is applied to the outside of the casting ring 10 and during the rotation of the casting ring 10 solidifies thereon, so that it can be drawn off the ring in the form of a strip. In the zone of the position at the start of casting, defined by the tundish or casting metal 9, the casting ring 10 is borne internally on two wheels 11*a*, 11*b* forming rollers which are so mounted rigidly via a supporting element 12 in the radial direction of the casting ring 10 that the exit gap between the casting ring 10 and the tundish or casting nozzle 9 remains unchanged. Any small changes in the casting gap due to the thermal expansion of the casting ring cross-section can be detected and corrected by a casting gap control system. Disposed opposite the roller 11*a*, 11*b* is a roller 13*a*, 13*b* taking the form of two wheels 13*a*, 13*b* on which the casting ring 10 is also borne internally and which are borne radially adjustably on a preferably hydraulic supporting element 14 and can also be pivoted, for example, against the force of a spring 15. FIG. 1 shows on the left the state of the cold casting ring 10 and on the right the state of the hot casting ring, which has expanded on one side by the one-sided action of the molten metal. The resulting conical deformation is absorbed by the radially adjustable and pivotable wheels 13*a*, 13*b*, so that the position of the casting ring 10 is maintained in the zone of the position at the start of casting of the tundish 9, bearing against the rollers 11, 11*b*, so that despite the widening of the casting ring 10, the exit gap does not change.

This basic structure can be put into effect in the way illustrated in embodiments 2 to 7.

In all the embodiments the casting ring 20, 30, 40, 50 bears at at least one end face, via an entraining disc 20*a*, 30*a*, 40*a*, 50*a*, a driving element 20*b*, 30*b*, 40*b*, 50*b*, via which the casting ring 20, 30, 40, 50 can be externally driven. Furthermore, each casting wheel has a rigid carrying shaft 26, 36, 46, 56 on which wheels 21, 23, 31*a*, 31*b*, 33*a*, 33*b*, 41*a*–41*c*, 43*a*–43*c*, 51*a*–51*c*, 53 are borne via supporting elements 22, 24, 32, 34*a*, 34*b*, 42, 44, 52, 54. As the various embodiment show, the casting rings 20, 30, 40, 50 are borne and mounted internally purely peripherally at at least two places, but preferably at three or more places. The wheels 21, 31*a*, 31*b*, 41*a*, 41*b*, 41*c*, 51*b*, 51*c*, 51*d* are disposed rigidly via their supporting elements 22, 32, 42, 52 on the rigid carrying shaft 26, 36, 46, 56, while the opposite wheels 23, 33*a*, 33*b*, 43*a*, 43*b*, 43*c*, 53 are radially adjustable, preferably hydraulically, via their supporting elements 24, 34*a*, 34*b*, 44, 54. If a radially adjustable roller is formed by a number of wheels 33*a*, 33*b*, 43*a*, 43*b*, 43*c*, the wheels 33*a*, 33*b*, 43*a*, 43*b*, 43*c* are radially adjustable independently of one another. This can be effected via individual supporting elements 34*a*, 34*b* (FIG. 3) or by a pivoting bearing 47 (FIG. 4). This enables the casting ring 40 to be adjusted to an inclined position (FIG. 1—right-hand side). If a number of rollers 43*a*, 43*b*, 43*c* are disposed opposite one another offset in the peripheral direction in the position at the start of casting (FIGS. 4 and 6), and said rollers 43*a*, 43*b*, 43*c* are borne by a rigid frame 48, said rigid frame 48 should be pivotable around a pivot bearing 49.

To fix the axial position of the casting ring 20, 30, 40, 50 in relation to the rollers, preferably the inside of each casting ring 20, 30, 40, 50 is formed with a guide track 29, 39*a*, 49*a*, 59 in the form of an annular groove in which at least one set of rollers 21, 23, 31*a*, 33*a*, 41*a*, 41*c*, 43*a*, 43*c* engages. If a number of rollers, more particularly adjusted in their spacing, are disposed one beside the other, a second recess 39*b*, 49*b* can be provided which, however, performs no guiding functions and for this reason is wider than the associated wheel 31*b*.

However, the casting ring 20, 30, 40, 50 can also be axially guided by means of external guide elements.

For adaptation to different widths, not only can a number of wheels be disposed one beside the other on the rigid carrying shaft 26, 36, 46, 56, but the wheels can also be disposed adjustable in their spacing from one another, as indicated by the double arrow of wheel 31*b* in the starting example (FIG. 3).

To prevent accidents and/or as a protection for the guide rollers and supporting elements against dirtying and/or for the formation of an internal cooling chamber, the end faces of the casting ring 20, 30, 40, 50 are closed by two plates 20*a*, 20*a, 30***a*, 30*a, 40***a*, 40*a, 50a, 50*a, of which the first plate at the same time forms the entraining disc for the driving elements, for example, a V-belt pulley. A seal can be provided at the lead-in of the carrying shaft 26, 36, 46, 56 through the plate 20*a*, 30*a*, 40*a*, 50*a*. The coolant is supplied in a controlled manner to the resulting cavity via spraying nozzles disposed peripherally distributed in the upper zone of the casting wheel. The plates on both sides 20*a*, 20*a, 30***a*, 30*a, 40***a*, 40*a, 50***a*, 50*a** prevent the emergence of coolant to the outside. The coolant is collected in the lower zone of the casting wheel and removed thence via pipes.

Wording on FIG. 1: (left-hand side)=cold casting ring; (right-hand side)=hot casting ring.

We claim:

1. A casting wheel for a strip casting machine comprising, a casting ring rotatably mounted internally on rollers, at least one first roller mounted radially rigid inside of said casting ring on at least one first supporting element in a first zone of feeding molten metal of said casting ring, at least one second roller mounted radially adjustably opposite said first zone on at least one second supporting element, wherein said at least one second roller and said at least one second supporting element adjusts radially so that said at least one first roller and at least one second roller continue to support said casting ring, which is conically deformed from thermal expansion, by pulling said casting ring against said first rollers so as to maintain said casting ring in a constant position in said first zone, wherein at least one of said second rollers is pivoted in relation to the axis of the casting ring.

2. A casting wheel according to claim 1, wherein at least one of said second rollers is mounted resiliently to said second supporting elements.

3. A casting wheel according to claim 1, further comprising a common rigid carrying shaft for supporting said first and second supporting elements.

4. A casting wheel according to claim 3, wherein said carrying shaft is rotatably adjustable.

5. A casting wheel according to claim 1, further comprising at least two of said first rollers offset in relation to one another in the peripheral direction of said casting ring.

6. A casting wheel according to claim 1, wherein said at least one first roller and said at least one second roller comprise a plurality of axially spaced-out wheels.

7. A casting wheel according to claim 6, wherein spacing between said spaced-out wheels of each first roller is adjustable.

8. A casting wheel according to claim 1, wherein said second rollers have at least two wheels and said wheels are mounted on a common pivotable shaft.

9. A casting wheel according to claim 1, wherein the casting ring has internally at least one guide track in said first zone.

10. A casting wheel according to claim 1, further comprising a means for guiding the casting wheel axially between external guide elements.

11. A casting wheel according to claim 1, wherein said first and second rollers are mounted freely rotatable and the casting ring bears an external driving element on at least one side.

12. A casting wheel according to claim 3, wherein the casting ring is closed at both end faces by first and second plates, the carrying shaft being sealed at one end by one of said plates.

13. A casting wheel for a strip casting machine comprising, a casting ring rotatably mounted internally on rollers, at least one first roller mounted radially rigid inside of said casting ring on at least one first supporting element in a first zone of feeding molten metal of said casting ring, at least one second roller mounted radially adjustably opposite said first zone on at least one second supporting element, wherein said at least one second roller and said at least one second supporting element adjusts radially so that said at least one first roller and at least one second roller continue to support said casting ring, which is conically deformed from thermal expansion, by pulling said casting ring against said first rollers so as to maintain said casting ring in a constant position in said first zone, wherein said at least one first roller and said at least one second roller comprise a plurality of axially spaced-out wheels, and each wheel of said second rollers is adjustable independently of one another.

14. A casting wheel according to claim 13, wherein at least one of said second rollers is pivoted in relation to the axis of the casting ring.

15. A casting wheel according to claim 13, wherein at least one of said second rollers is mounted resiliently to said second supporting elements.

16. A casting wheel according to claim 13, wherein at least one of said second rollers is pivoted in relation to the axis of the casting ring.

17. A casting wheel according to claim 13, further comprising a common rigid carrying shaft for supporting said first and second supporting elements.

18. A casting wheel according to claim 17, wherein said carrying shaft is rotatably adjustable.

19. A casting wheel according to claim 13, further comprising at least two of said first rollers offset in relation to one another in the peripheral direction of said casting ring.

20. A casting wheel according to claim 13, wherein spacing between said spaced-out wheels of each first roller is adjustable.

21. A casting wheel according to claim 13, wherein said second rollers have at least two wheels and said wheels are mounted on a common pivotable shaft.

22. A casting wheel according to claim 13, wherein the casting wheel has internally at least one guide track in said first zone.

23. A casting wheel according to claim 13, further comprising a means for guiding the casting wheel axially between external guide elements.

24. A casting wheel according to claim 13, wherein said first and second rollers are mounted freely rotatable and the casting ring bears an external driving element on at least one side.

25. A casting wheel according to claim 17, wherein the casting ring is closed at both end faces by first and second plates, the carrying shaft being sealed at one end by one of said plates.

* * * * *